US012121078B2

(12) United States Patent
Clayton

(10) Patent No.: US 12,121,078 B2
(45) Date of Patent: Oct. 22, 2024

(54) CLIP SYSTEM FOR NURSING BRAS

(71) Applicant: FLORIDA STATE UNIVERSITY RESEARCH FOUNDATION, INCORPORATED, Tallahassee, FL (US)

(72) Inventor: Jessica Ridgway Clayton, Tallahassee, FL (US)

(73) Assignee: Florida State University Research Foundation, Incorporated, Tallahassee, FL (US)

( * ) Notice: Subject to any disclaimer, the term of this patent is extended or adjusted under 35 U.S.C. 154(b) by 0 days.

(21) Appl. No.: 17/972,973

(22) Filed: Oct. 25, 2022

(65) Prior Publication Data

US 2023/0125155 A1 Apr. 27, 2023

Related U.S. Application Data

(60) Provisional application No. 63/272,426, filed on Oct. 27, 2021.

(51) Int. Cl.
*A41C 3/12* (2006.01)
*A41C 3/04* (2006.01)

(52) U.S. Cl.
CPC . *A41C 3/12* (2013.01); *A41C 3/04* (2013.01)

(58) Field of Classification Search
CPC .... A41C 3/12; A41C 3/04; A41B 9/16; A41F 1/006; A41F 15/00
USPC ..... 450/86, 36
See application file for complete search history.

(56) References Cited

U.S. PATENT DOCUMENTS

| | | | | |
|---|---|---|---|---|
| 2,895,480 | A * | 7/1959 | Fixel | A41F 17/00 450/111 |
| 3,179,109 | A * | 4/1965 | Born | A41F 1/006 623/7 |
| 5,313,669 | A * | 5/1994 | Rasdell | A41F 17/00 2/112 |
| 6,179,687 | B1 * | 1/2001 | Lee | A41F 15/002 450/88 |
| 8,640,266 | B2 | 2/2014 | Best et al. | |
| D842,584 | S * | 3/2019 | Soohoo | D2/706 |
| 10,897,939 | B1 * | 1/2021 | Hopkins | A41D 13/0568 |
| 10,905,173 | B1 * | 2/2021 | Kosak | A41F 15/002 |
| 2018/0235288 | A1 * | 8/2018 | Samson | A41C 3/0028 |
| 2018/0352884 | A1 * | 12/2018 | Vanos | A41F 1/006 |
| 2021/0084996 | A1 * | 3/2021 | Ironi | A41C 3/04 |

* cited by examiner

*Primary Examiner* — Gloria M Hale
(74) *Attorney, Agent, or Firm* — Thomas | Horstemeyer, LLP

(57) ABSTRACT

A wearable clip system comprises a garment having a shoulder strap with a front portion comprising an upper section having two ends, wherein one end attaches to a back portion of the shoulder strap and a second end attaches to a first clip portion of a middle clip; a lower section having two ends, wherein one end attaches to a first clip portion of an end clip and a second end attaches to the first clip portion of the middle clip; and an additional strap section having two ends, wherein one end attaches to the back portion of the shoulder strap and a second end attaches to a second clip portion of the middle clip. The system further includes a second clip portion of the end clip that attaches to the garment and is configured to releasably engage with the first clip portion of the end clip.

20 Claims, 13 Drawing Sheets

CLIP SYSTEM FOR NURSING BRAS

CROSS-REFERENCE TO RELATED APPLICATIONS

This application claims the benefit of and priority to U.S. Provisional Application Ser. No. 63/272,426, having the title "CLIP SYSTEM FOR NURSING BRAS," filed on Oct. 27, 2021, the disclosure of which is incorporated herein by reference in its entirety.

BACKGROUND

The American Academy of Pediatrics recommends that babies should be exclusively breastfed until 6 months old and should continue to have breastmilk as part of their diet until 2 years old. However, the Centers for Disease Control and Prevention (CDC) recently reported that approximately only 46% of babies in the United States (U.S.) are exclusively breastfed for 3 months, and by 6 months that rate drops to 25%. It is reported that 60 percent of mothers do not breastfeed for the duration that they initially intend to due to issues with latching, unsupportive work policies, and cultural norms. Furthermore, breastfeeding is a time-consuming process in which mothers report feeding their infants approximately every 3 hours for 20-30 minutes per feeding session. This equates to about 4 hours per day. Due to this time, and the repetition of body posture and sitting position throughout the day, women reported backaches and tension through their shoulders, as well as neck, arm, and wrist pain while breastfeeding. With all of this in mind, a design solution is needed to help mothers address issues with breastfeeding in hopes to facilitate a better breastfeeding experience and as a result, increasing the duration in which mothers breastfeed their infants.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

The present disclosure describes various embodiments of a wearable clip system and related methods. While breast feeding has many positive health outcomes for babies and mothers alike, one of the biggest complaints of new mothers is the awkwardness and pain of nursing while holding their shirt up by tucking it under their chin. This method requires a mother to sit for the duration of feeding her baby with her chin tightly tucked to her chest. Over just a few minutes, this results in neck and back pain let alone, up to 4 hours a day. Another challenge of this shirt holding technique is that it is extremely hard for a mother to adequately view her breast to assist her baby with a proper latch. Accordingly, it is advantageous to provide a system for holding a mother's shirt up to allow for nursing of her baby without discomfort or awkwardness.

Correspondingly, an exemplary wearable clip system of the present disclosure works to hold a mother's shirt up while she is breastfeeding her baby. The clip system is seamlessly integrated into the front shoulder strap of a wearable garment, such as but not limited to a bra (e.g., a nursing bra). Accordingly, the clip system can be integrated within a variety of garment types having shoulder straps and foldable or removable panels, such as different types of bras that may or may not feature cups, bridges, bands, etc. and/or may have different style shoulder straps than those provided in the following illustrative examples. As such, the invention is not limited to the embodiments shown in the following figures and/or accompanying descriptions.

Figure 1A:
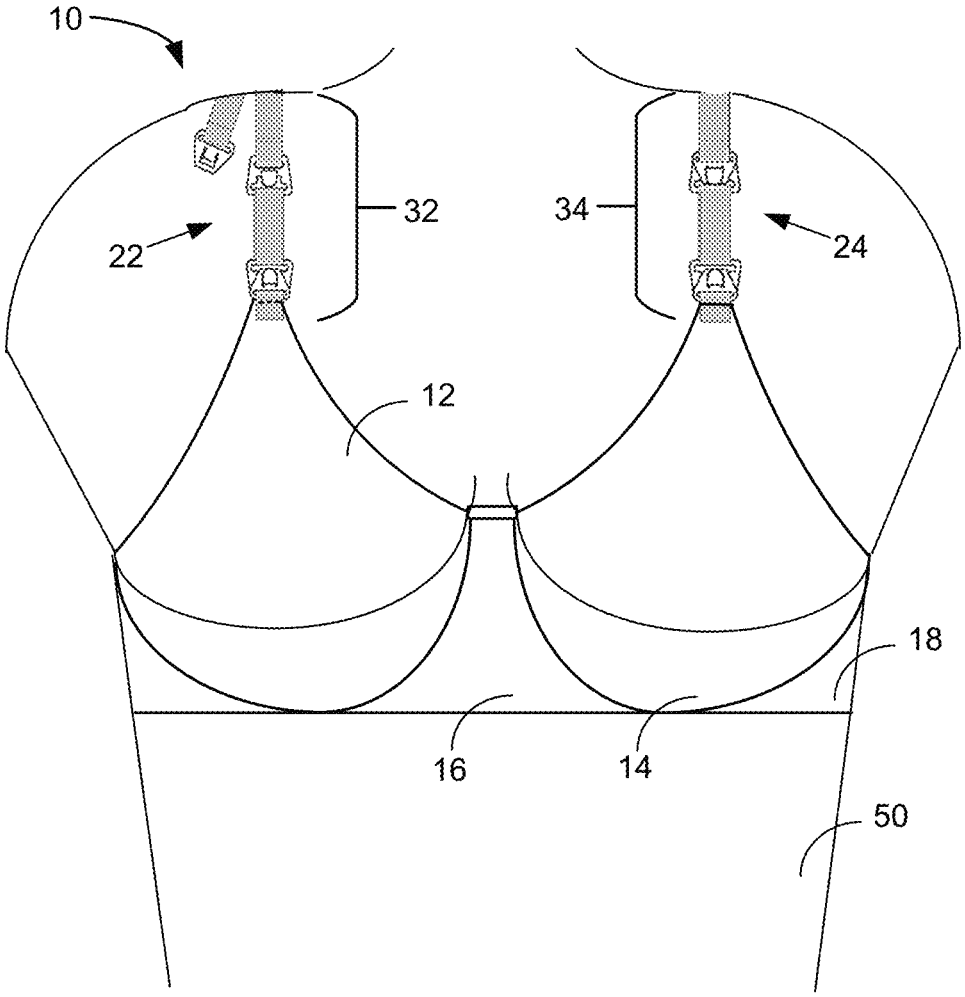
FIGS. 1A-1C show an exemplary nursing bra having an integrated wearable clip system modeled by a wearer at front, back, and top views respectively in accordance with various embodiments of the present disclosure.
Figure 1B:
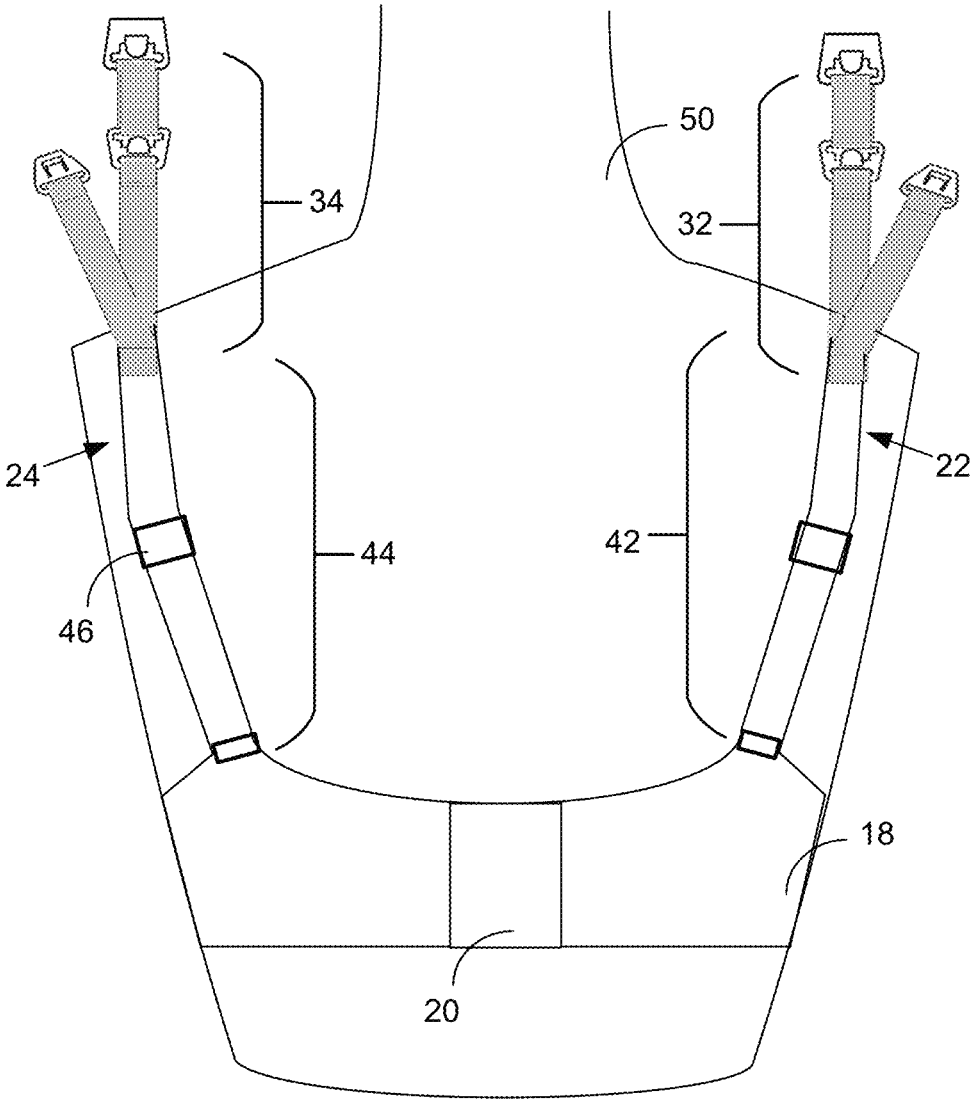
Figure 1C:
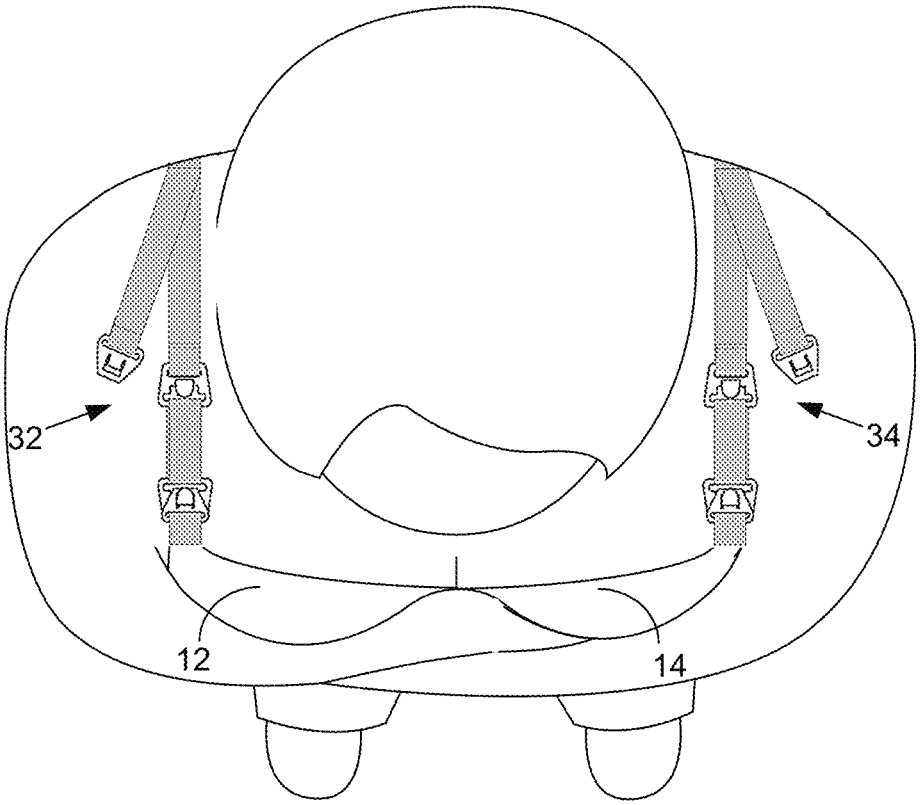

Referring now to FIGS. 1A-1C, an exemplary nursing bra 10 is shown being worn by a wearer 50 at front, back, and top views with respect to the wearer, where the bra 10 is designed to support the breasts of the wearer 50. The bra 10 includes first and second cups 12, 14, a bridge 16 between the cups, and a band 18 that extends from under the cups and wraps around a back of the wearer 50 and can include a releasable closure 20 (e.g., hook and eye closure). With respect to the cups 12, 14, in various embodiments, one or more of the cups can flip or fold down to expose a wearer's breast. In this way, a nursing mother can temporarily open a cup 12, 14 to allow for easy access to a nipple of the breast in order to allow for breastfeeding of an infant baby. The bra 10 further includes first & second shoulder straps 22, 24 of stretchy elastic material connected to a cup 12, 14 at a front portion 32, 34 (shown in gray in the figures) of the shoulder strap 22, 24 that extends over the shoulder of the wearer 50 and connects to a back portion 42, 44 of the shoulder strap 22, 24 that extends across the back of the wearer 50 to the band 18. The back portion 42, 44 of the shoulder straps may include a slide adjuster mechanism 46 (e.g., a triglide slide) that can adjust a length of the back portion of the shoulder strap.

Figure 2A:
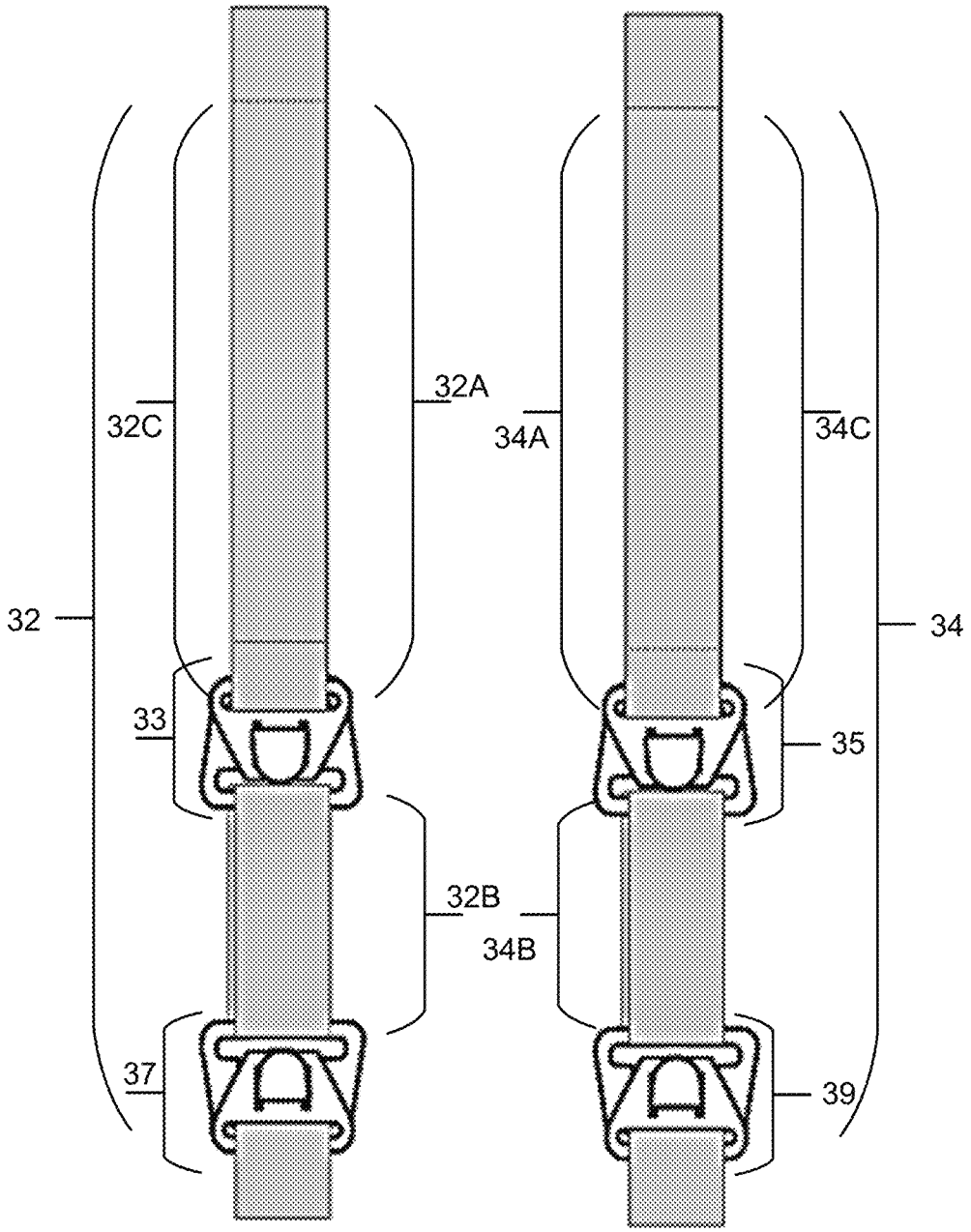
FIGS. 2A-2B shown an exemplary front portion of shoulder straps of an integrated wearable clip system in accordance with various embodiments of the present disclosure.
Figure 2B:
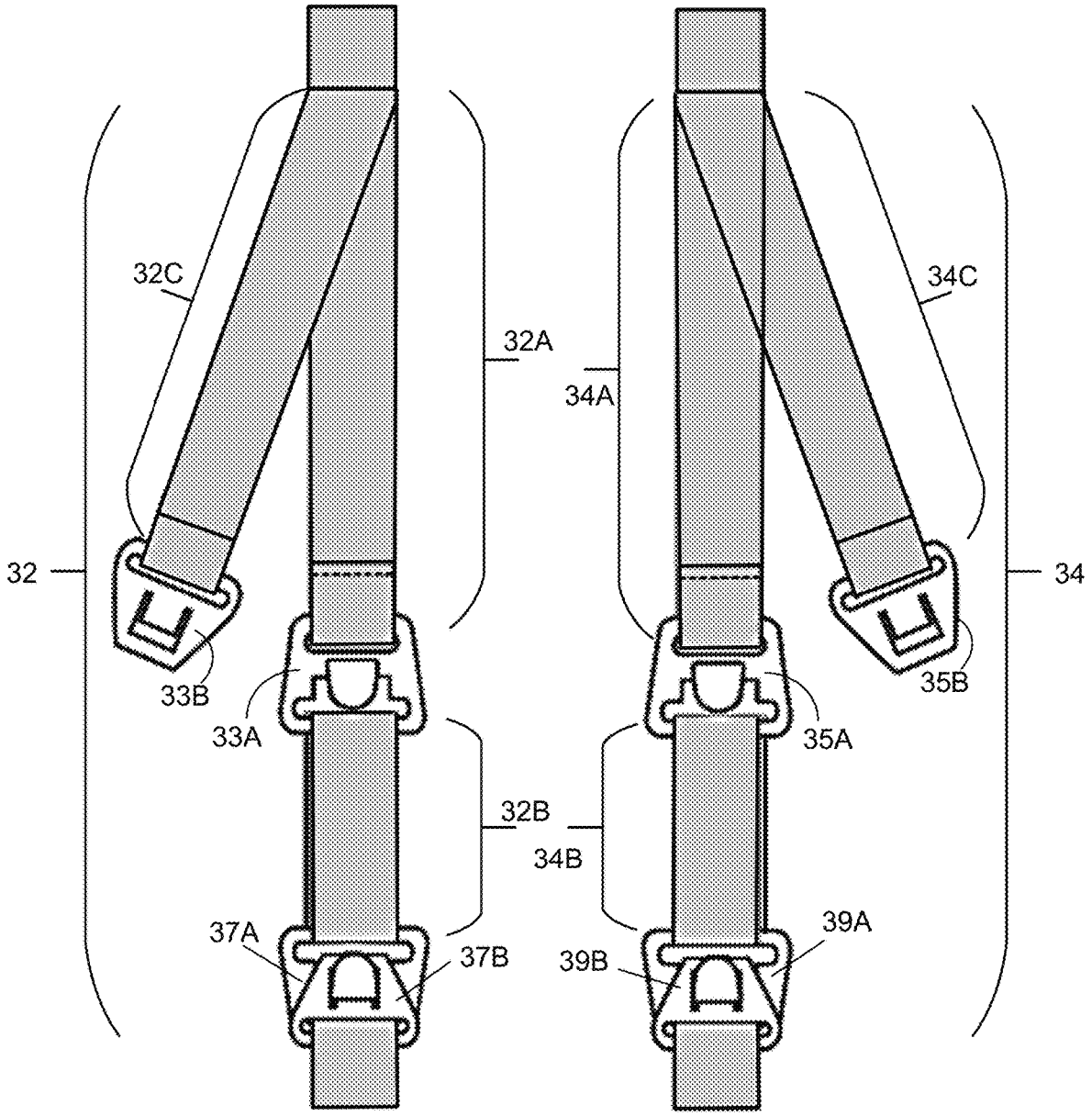

As demonstrated in FIGS. 2A-2B, an exemplary front portion 32, 34 of the shoulder straps 12, 14 include an upper section 32A, 34A, a lower section 32B, 34B, and an additional strap section 32C, 34C. One end of the upper section 32A, 33B is attached or coupled to an upper end of the back portion 42, 44 of the shoulder strap, such as but not limited to stitching or other type of securing mechanism, and the other end and is attached to an upper end of the lower section 32B, 34B via a first clip portion 33A, 35A of a middle clip or clasp 33, 35 (e.g., having a post or a loop that is configured to mate with a corresponding loop or post) or other type of fastener (e.g., snap, hook and loop fastener, etc.) on the other end. Correspondingly, one or more of the shoulder straps can feature the additional strap section 32C, 34C that extends from an upper section 32A, 34A of the shoulder strap (above a respective cup) and hangs down a front of the wearer towards the respective cup. Accordingly, the additional strap section 32C, 34C has two ends, where one end is attached to the upper end of the back portion 42, 44 of the shoulder strap, such as but not limited to stitching or other type of securing mechanism, and the other end is attached to a second clip portion 33B, 35B of the middle clip 33, 35 which is configured to mate or engage with the first clip portion 33A, 35A of the middle clip 33, 35 in a closed position and form a loop with the upper section 32A, 34A of the upper section 32A, 34A of the front portion of the shoulder strap being on the bottom and the additional strap section 32C, 34C being on the top. In FIG. 1A, the front portion 34 of the right shoulder strap 24 (from the perspective of a viewer) is shown with the additional strap section 34C being in a closed position. Likewise, FIG. 2A shows the front portions 32, 34 of the shoulder straps in a closed position with respect to the additional strap sections 32C, 34C. Correspondingly, in FIG. 1A, the front portion 32 of the left shoulder strap 22 (from the perspective of a viewer) is shown with the additional strap section 32C being in an open position with the second clip portion 33B of the middle clip 33 not being engaged with the first clip portion 33A of the middle clip 33. Likewise, FIG. 2B, in addition to FIGS. 1B-1C, show the front portions 32, 34 of the shoulder straps in an open position with respect to the additional strap sections 32C, 34C. Additionally, in FIG. 1B, the lower sections 32B, 34B are shown in open positions and are not engaged with or coupled to the cups 12, 14 of the bra 10, while in FIGS. 1A, 1C, 2A, and 2B, the lower sections 32B, 34B are shown in closed positions and are engaged with or coupled to a front piece of the garment in the form of cups of the bra 10.

While the an upper end of the lower section 32B, 34B of the front portion of the shoulder strap is attached to the first clip portion 33A, 35A of the middle clip 33, 35, the opposite end of the lower section 32B, 34B is attached to a first clip portion 37A, 39A of an end clip or clasp 37A, 39B (e.g., having a post or a loop that is configured to mate with a corresponding loop or post) or other type of fastener (e.g., snap, hook and loop fastener, etc.) on the other end. In various embodiments, the middle and/or end clips can be composed of hard plastic or metallic materials.

Figure 3:
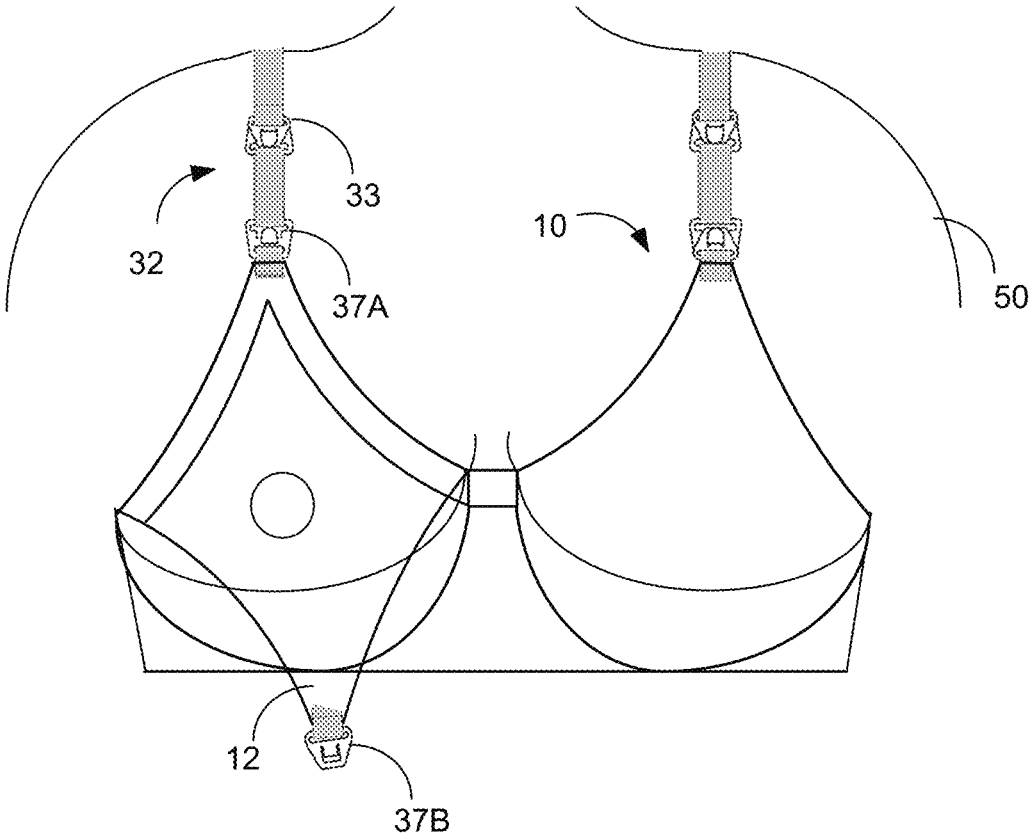
FIG. 3 shows an exemplary nursing bra having an integrated wearable clip system modeled by a wearer with an unlocked cup of the bra folded down in accordance with various embodiments of the present disclosure.

To connect the front portion 32, 34 of the shoulder strap to the cup 12, 14, the lower section 32B, 34B of the front portion of the shoulder strap is attached to the first clip portion 37A, 39A of the end clip 37, 39, where the first clip portion is configured to mate or engage with a second clip portion 37B, 39B of the end clip 37, 39 that is also attached or coupled to a top or apex of the corresponding cup 12, 14. By disengaging or unlocking the second clip portion 37B, 39B of the end clip 37, 39 with the first clip portion 37A, 39A of the end clip 37, 39 (and assuming an open position), one or more of the cups 12, 14 can be allowed to flip or fold down exposing the wearer's breast, as illustrated in FIG. 3.

Figure 4A:
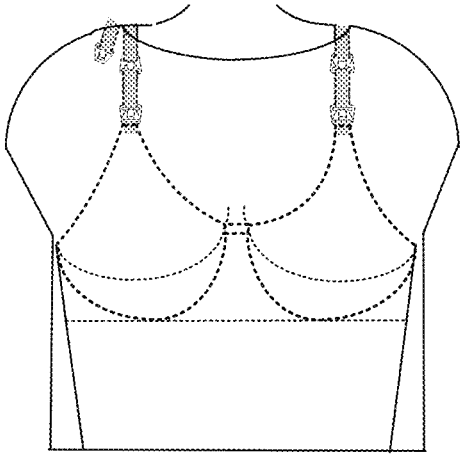
FIGS. 4A-4C demonstrate an exemplary wearable clip system being used in stages to hold a hem of a top garment of a wearer at one shoulder or at two shoulders in accordance with various embodiments of the present disclosure.

Thus, the additional strap section 32C, 34C having the middle clip 33, 35 is a new component which can serve to secure a wearer's outer garment in place above a cup 12, 14 of the bra. For example, the additional straps section 32C, 34C can loop through a hem and neckline of a mother's shirt or blouse and then clip back into place on the shoulder strap 22, 24 of the bra via the middle clip 33, 35 while a wearer can easily expose a breast in order to feed an infant without hampering the wearer and interfering with the feeding process. This two-clip system integrated within a bra allows a mother to clearly see her infant to ensure a proper latch. Additionally, the function of holding a mother's shirt up while nursing frees the mother from tucking the shirt under her chin which results in an uncomfortable and painful nursing position. Mother's often complain about neck and back pain from nursing in this hunched over and chin tucked, uncomfortable position. This integrated clip system also allows the mother to keep her shirt on while nursing (or pumping) and avoids having to purchasing nursing specific apparel many of which only provide discrete nursing coverage yet lack functionality. The wearable clip system is bilateral but can be used unilaterally depending on if a mother is breastfeeding or pumping, as demonstrated in FIGS. 4A-4C. Here, FIG. 4A depicts a wearer wearing an exemplary bra integrated with the clip system under a shirt, where in FIG. 4B, the wearer has secured a hem of the shirt above the left cup 12 (from the perspective of a viewer) using the left additional strap section 32C and middle clip 33 of the shoulder strap thereby unilaterally exposing the wearer's left bra cup 12*a* and in FIG. 4C, the wearer has secured a hem of the shirt above the left and right cups 12, 14 using the left and right additional strap sections 32C, 34C and middle clips 33, 35 of the shoulder straps of the bra thereby bilaterally exposing the wearer's left and right bra cups 12, 14.

Figure 5A:
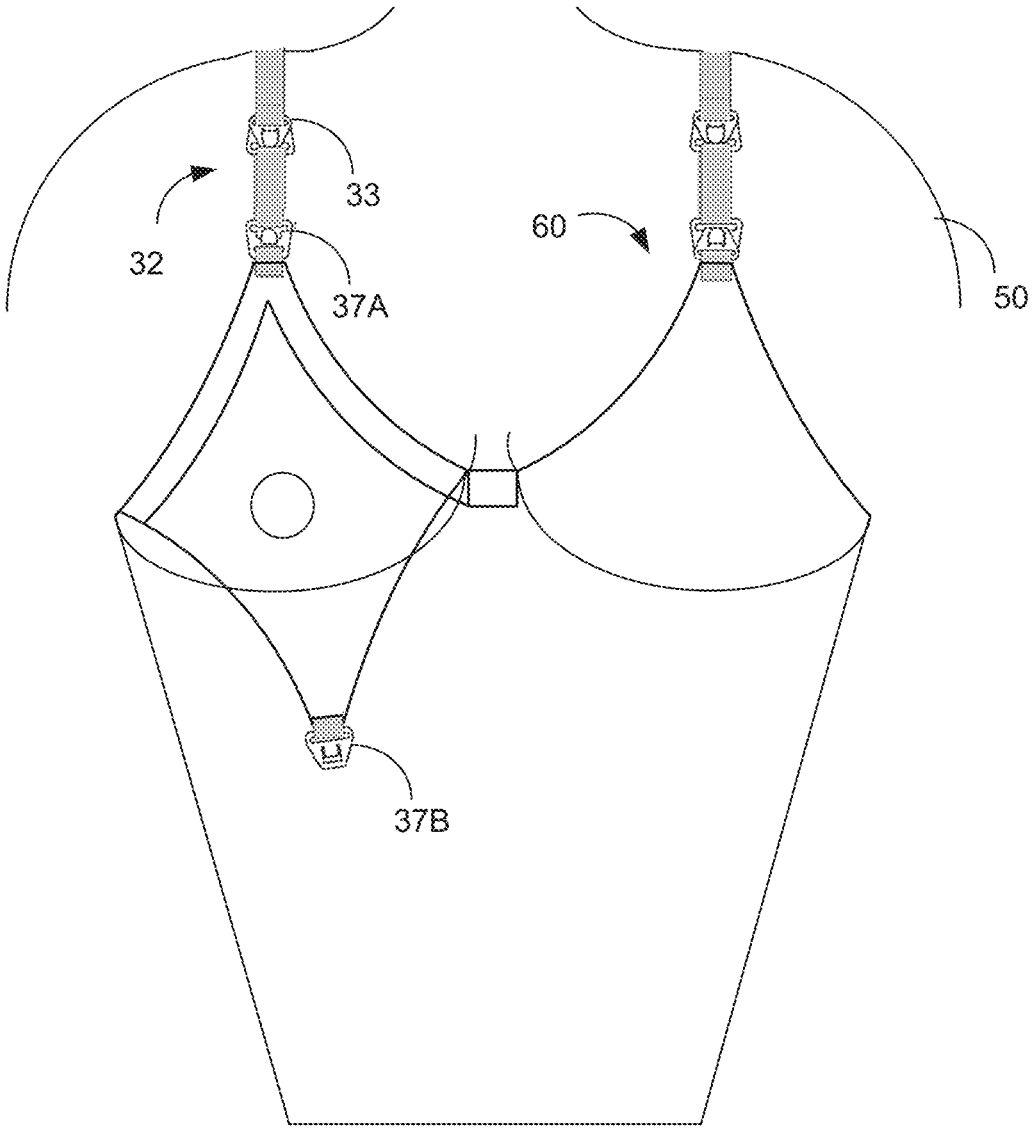
FIGS. 5A, 5B, and 5C show an exemplary wearable clip system integrated in the shoulder straps of a nursing tank top garment, a nursing nightgown garment, and a garment with a kangaroo pouch, each having a folded down panel in accordance with various embodiments of the present disclosure.
Figure 5B:
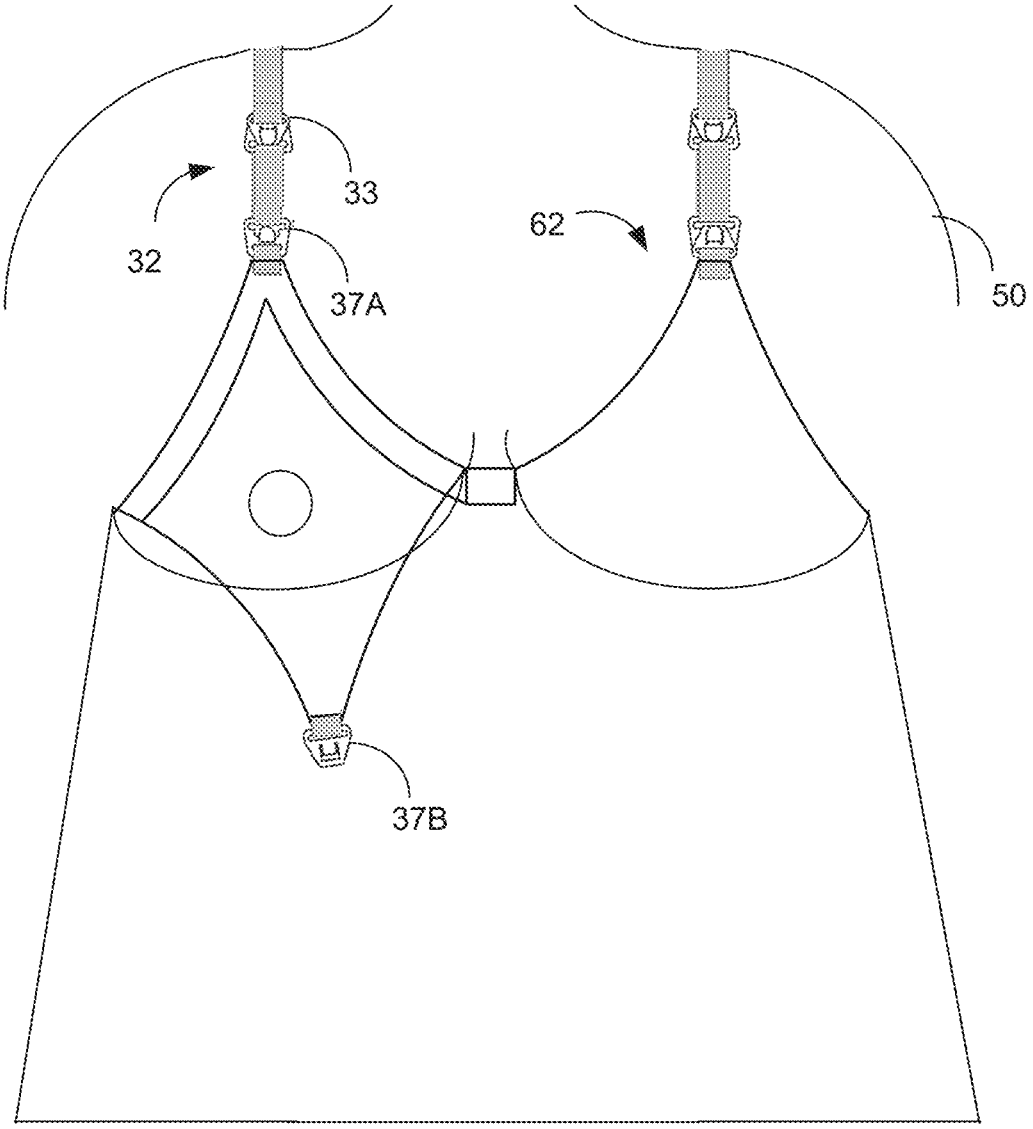
Figure 5C:
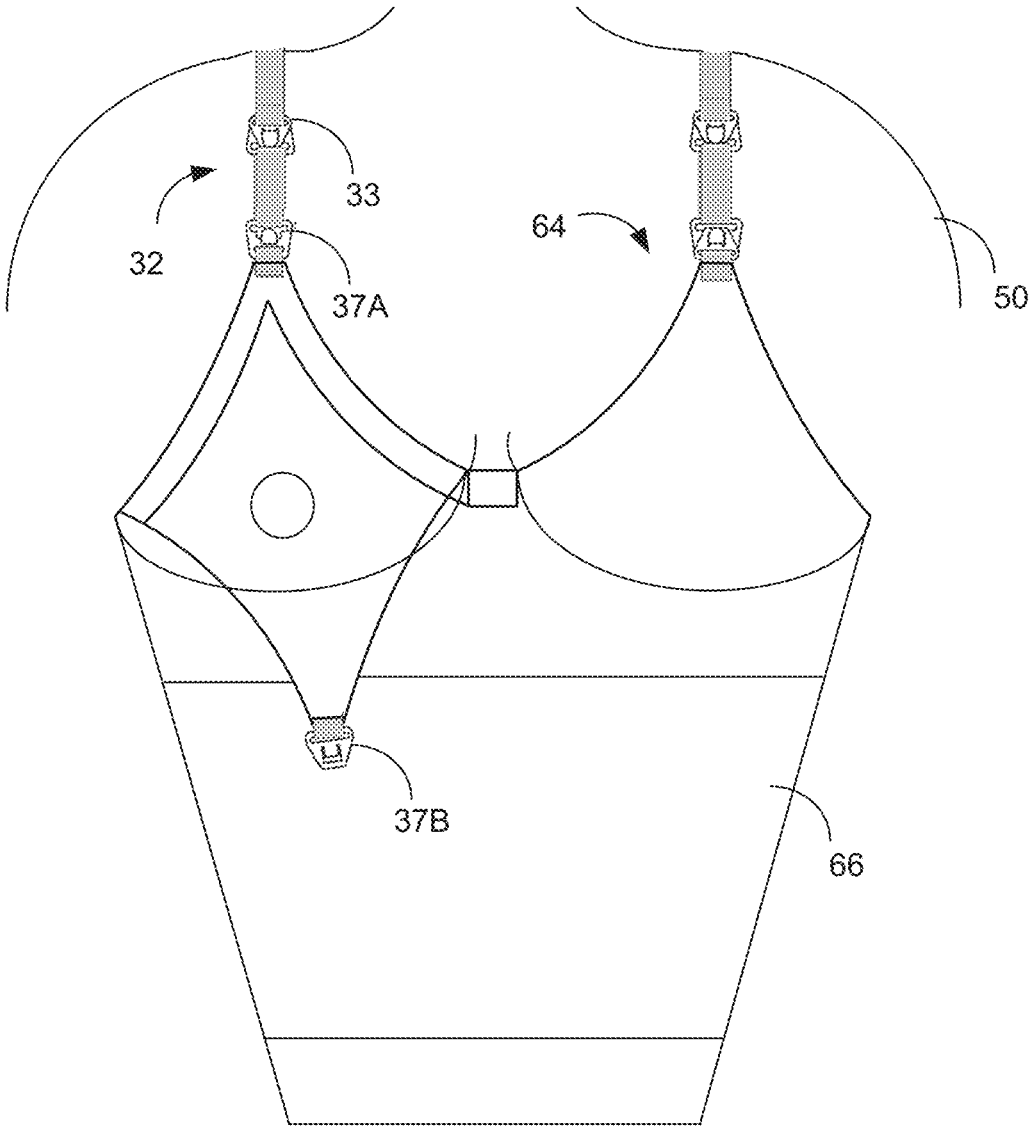
Figure 6A:
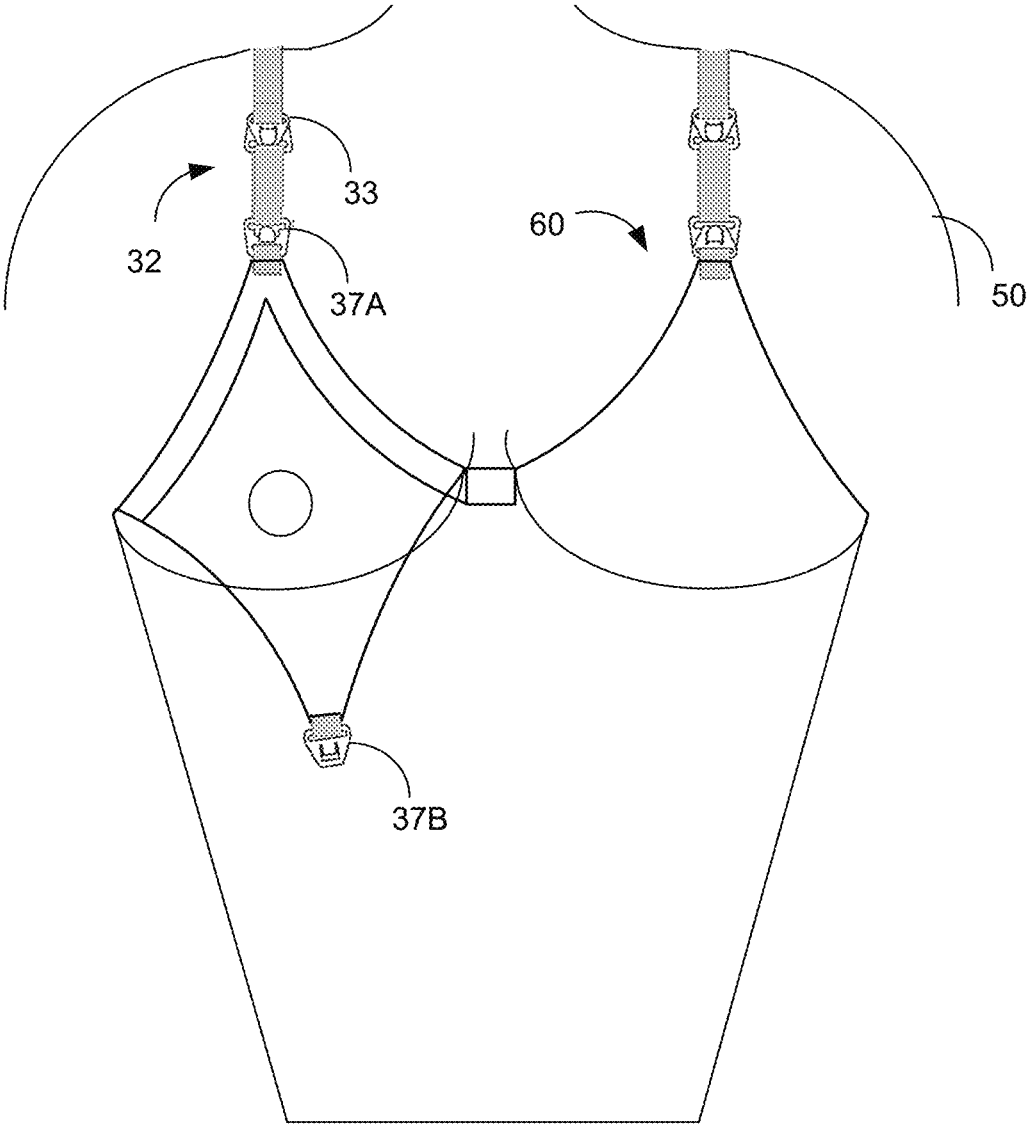
Figure 6B:
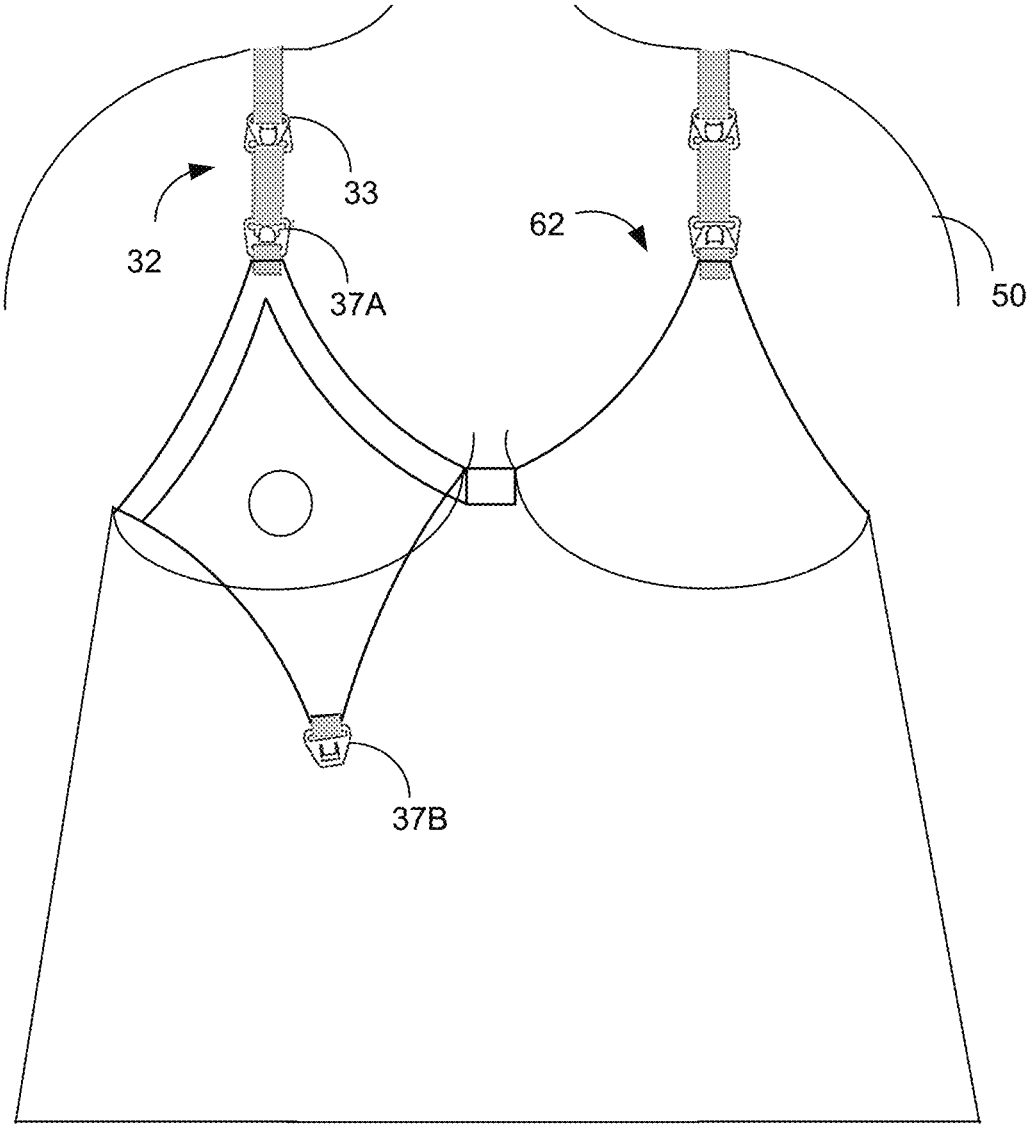
Figure 6C:
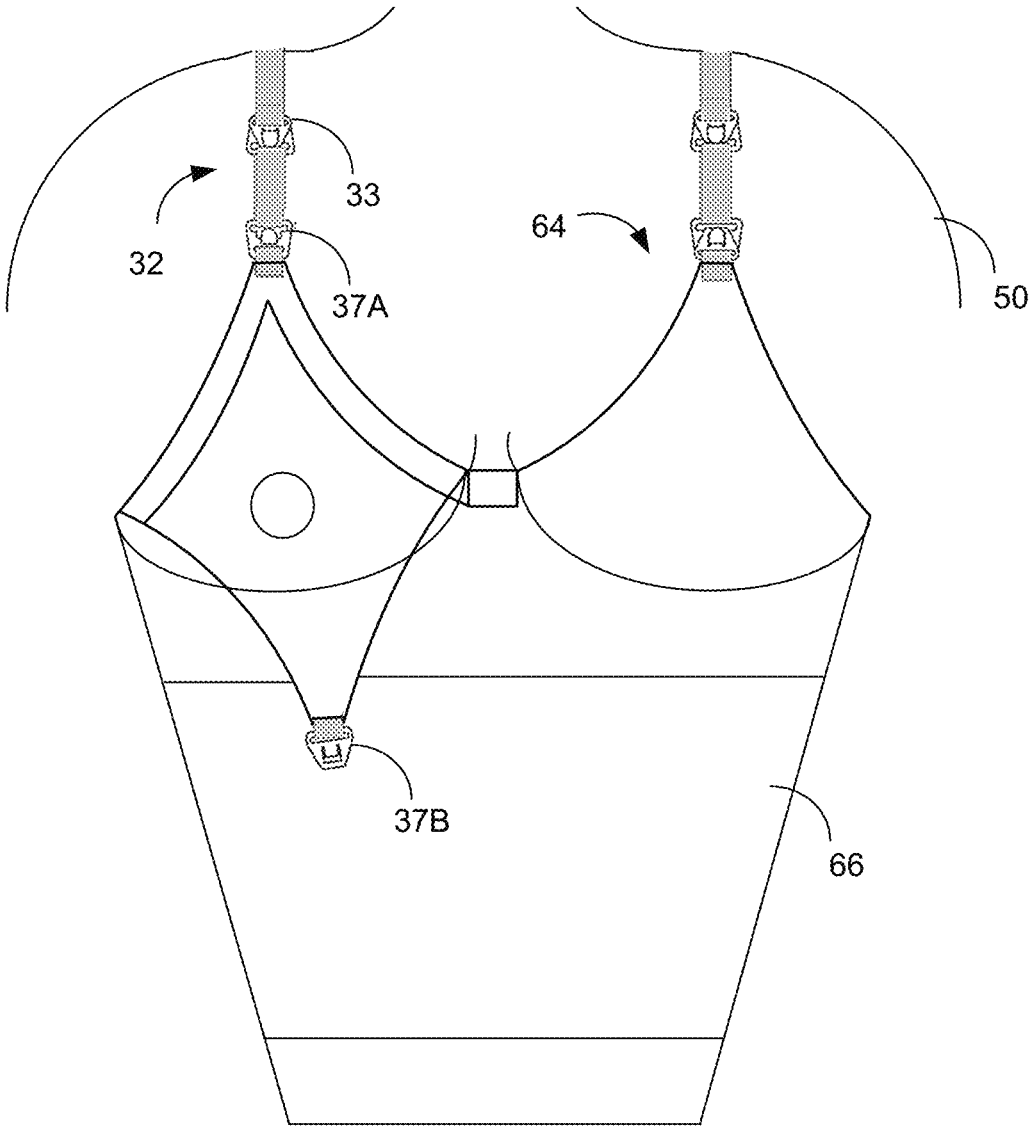

According to preliminary research, there is not a product on the market or a current patent that functions to solve the same problem as the disclosed invention. Current nursing bras are a one clip system which only allow for the exposure of the breast for feeding, but do not provide any type of aid in holding a woman's shirt up and away from her breast and baby. Since many women struggle with breastfeeding, this type of product will aid in making the process easier for women by allowing them to clearly view their breast and baby. A proper latch is essential for successful breast feeding and a clear view of the baby at the breast is needed. Additionally, this product is designed to allow mothers to sit a in a more comfortable position while breastfeeding. An exemplary wearable clip system of the present disclosure solves this issue by comfortably and easily holding up the shirt for the mother above and away from her baby and breast. It will allow mothers to have proper posture during breastfeeding. Further, an exemplary wearable clip system is integrated with a bra (or other undergarment) that a woman will be wearing and does not require the purchase or use of an additional product in addition to a wearable bra. However, in some embodiments, the exemplary wearable clip system can be integrated into a variety of wearable and/or nursing undergarments, such as tank tops, kangaroo care garments, nursing nightgowns, etc. that have foldable panels (e.g., a cup, a chest-covering portion of the garment, etc.) for allowing access to the wearer's chest/breast For example, FIGS. 5A-5C illustrate the exemplary wearable clip system integrated in the shoulder straps of a nursing tank top garment 60, a nursing nightgown garment 62, and a garment 64 with a kangaroo pouch 66, respectively. Moreover, an exemplary wearable clip system can have a variety of uses, in addition to nursing, that can take advantage of securing a garment to allow easy to a wearer's chest, such as medical or health treatments, application/removal of medical devices to/from a user's chest, etc.

In brief, the present disclosure describes various wearable clip systems and methods. One such system and/or method, among others, includes a garment 60 of clothing having at least one shoulder strap 22, 24, wherein the at least one shoulder strap 22, 24 includes a front portion 32, 34 of the shoulder strap that is coupled to a front piece of the garment and a back portion 42, 44 coupled to a back piece of the garment 60. In various embodiments, the front portion 32, 34 of the shoulder strap comprises an upper section 32A, 34A having two ends, wherein one end of the upper section 32A, 34A is attached to the back portion 42, 44 of the shoulder strap and a second end is attached to a first clip portion 33A, 35A of a middle clip 33, 35. The front portion 32, 34 further includes a lower section 32B, 34B having two ends, wherein one end of the lower section 32B, 34B is attached to a first clip portion 37A, 39A of an end clip 37, 39 and a second end of the lower section 32B, 34B that is attached to the first clip portion 33A, 35A of the middle clip 33, 35; and an additional strap section 32C, 34C having two ends, wherein one end of the additional strap section 32C, 34C is attached to the back portion 42, 44 of the shoulder strap 22, 24 and a second end of the additional strap section 32C, 34C is attached to a second clip portion 33B, 35B of the middle clip 33, 35, wherein the second clip portion 33B, 35B of the middle clip 33, 35 is configured to releasably engage with the first clip portion 33A, 35A of the middle clip 33. The system further includes a second clip portion 37B, 379 of the end clip 37, 39 that is attached to the front piece of the garment 60, wherein the second clip portion 37B, 39B of the end clip is configured to releasably engage with the first clip portion 37A, 39A of the end clip.

In one or more aspects of the system, the garment comprises a bra; the front piece of the garment comprises a cup of the bra; the garment comprises a nursing bra; the front piece of the garment comprises a foldable cup of the nursing bra; the garment comprises a tank top; the front piece of the garment comprises a foldable top panel of the tank top; the garment comprises a nightgown; the garment includes a kangaroo pouch for holding an infant; and/or the at least one shoulder strap comprises two shoulder straps, wherein each of the shoulder strap includes the additional strap section integrated in the shoulder strap.

In various embodiments, the garment and wearable clip system is constructed (but not limited to only being constructed) of a performance fabric containing 82% nylon, and 18% spandex. Such fabric provides performance features including moisture-wicking, shaping, and compression, along with its cooling properties. Additional features used for construction can include ⅝ inch fold-over elastic, bra strapping, and black nursing bra clips, in various embodiments. Draping techniques and then flat patterning may be used to pattern the bra in various embodiments. Additionally, embodiments of the garment design can takes into consideration the size of nursing bra pads which most breastfeeding mothers use to contain leaks. Accordingly, in various embodiments, cups of the garment may be sized and shaped to accommodate both disposable and reusable nursing pads. In various embodiments, for nursing bra garments, the elastic band around the bottom of the bra is designed to keep the bra fitted to the body and in place while also providing support and comfort. In various embodiments, extra clips that make up the clip system are also strategically placed below the collar bone area to reduce stress on the body. Further, in various embodiments, the back of the nursing bra has no clasp closure, in order to increase comfort and reduce bulk as mothers rest with their backs against a chair or other type of support while breastfeeding. Additionally, in various embodiments, the nursing bra has two fabric sling pieces that sit along the outside edge of the breast as an underlayer. These slings anchor the bra to the body when the clips are released to expose the breast for breastfeeding.

Figure 4B:
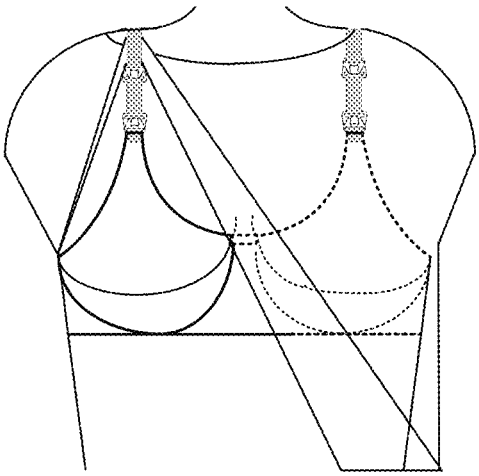
Figure 4C:
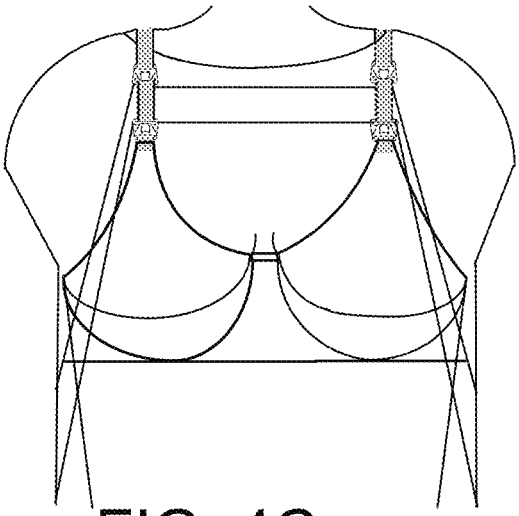

In various embodiments, the nursing bra garment has classic lines and shapes of both a traditional bra and a sports bra. The traditional strap placement and size allow for mothers to wear this underneath a variety of garments such that the wearable clip system itself nicely blends in with the strap configuration and is hardly noticeable as an added feature, which makes the addition of the clip system appealing to users as it does not affect the overall aesthetic appeal of the bra. In various embodiments, a sports bra with joint cup style accommodates variation in breast size throughout the course of the day as lactating mothers can experience engorgement of breasts. Accordingly, the wearable clip system of the present disclosure can integrate into the strap of a nursing bra and allows a mother to quickly and easily, clip their shirt up to allow for access to their breast. An exemplary embodiment of the system is made up of two clips (FIG. 1A, FIG. 4A), the first that unlatches the cup of the bra that folds down to expose the breast for feeding, and the second, which unclips to serve as a strap that loops through the hem and neckline of a mother's shirt and then clips to hold the shirt up and in place (FIG. 4B). The clip system can work bilaterally for a mother who wants to double pump or who is feeding twins (FIG. 4C), or unilaterally (FIG. 4B) for single breastfeeding or pumping. As a result, embodiments of the wearable clip system can increase breastfeeding satisfaction thereby increasing the duration in which mothers breastfeed supporting the goals of the CDC's Healthy Humans of 2030 (CDC, 2021). Further, the wearable clip system can be applied to different applications, such as supporting medical tubes for infants in the NICU during kangaroo care, among others.

It should be emphasized that the above-described embodiments are merely possible examples of implementations, merely set forth for a clear understanding of the principles of the present disclosure. Many variations and modifications may be made to the above-described embodiment(s) without departing substantially from the principles of the present disclosure. All such modifications and variations are intended to be included herein within the scope of this disclosure.

The invention claimed is:

1. A wearable clip system comprising:

a garment having at least one shoulder strap, wherein the at least one shoulder strap includes a front portion that is coupled to a front piece of the garment and a back portion coupled to a back piece of the garment, wherein the front portion of the shoulder strap comprises:

an upper section having two ends, wherein one end of the upper section is attached to the back portion of the shoulder strap and a second end is attached to a first clip portion of a middle clip;

a lower section having two ends, wherein one end of the lower section is attached to a first clip portion of an end clip and a second end of the lower section that is attached to the first clip portion of the middle clip; and an additional strap section having two ends, wherein one end of the additional strap section is attached to the back portion of the shoulder strap and a second end of the additional strap section is attached to a second clip portion of the middle clip, wherein the second clip portion of the middle clip is configured to releasably engage with the first clip portion of the middle clip; and a second clip portion of the end clip that is attached to the front piece of the garment, wherein the second clip portion of the end clip is configured to releasably engage with the first clip portion of the end clip.

2. The wearable clip system of claim 1, wherein the garment comprises a bra.

3. The wearable clip system of claim 2, wherein the front piece of the garment comprises a cup of the bra.

4. The wearable clip system of claim 2, wherein the front piece of the garment comprises a foldable panel of the bra.

5. The wearable clip system of claim 1, wherein the garment comprises a nursing bra.

6. The wearable clip system of claim 5, wherein the front piece of the garment comprises a foldable cup of the nursing bra.

7. The wearable clip system of claim 1, wherein the garment comprises a tank top.

8. The wearable clip system of claim 7, wherein the front piece of the garment comprises a foldable top panel of the tank top.

9. The wearable clip system of claim 1, wherein the garment comprises a nightgown.

10. The wearable clip system of claim 1, wherein the garment includes a kangaroo pouch for holding an infant.

11. The wearable clip system of claim 1, wherein the at least one shoulder strap comprises two shoulder straps, wherein each of the shoulder strap includes the additional strap section integrated in the shoulder strap.

12. A method of integrating a wearable clip system in a shoulder strap of a garment comprising:

coupling a front portion of the shoulder strap to a front piece of the garment, wherein the front portion of the shoulder strap comprises an upper section having two ends and a lower section having two ends;

coupling a back portion of the shoulder strap to a back piece of the garment;

attaching the back portion of the shoulder strap to one end of the upper section of the front portion of the shoulder strap;

attaching a second end of the upper section to a first clip portion of a middle clip;

attaching one end of the lower section of the front portion of the shoulder strap to a first clip portion of an end clip;

attaching a second end of the lower section of the front portion of the shoulder strap to the first clip portion of the middle clip;

attaching one end of an additional strap section to the back portion of the shoulder strap;

attaching a second end of the additional strap section to a second clip portion of the middle clip, wherein the second clip portion of the middle clip is configured to releasably engage with the first clip portion of the middle clip; and attaching a second clip portion of the end clip to the front piece of the garment, wherein the second clip portion of the end clip is configured to releasably engage with the first clip portion of the end clip.

13. The method of claim 12, wherein the garment comprises a bra.

14. The method of claim 13, wherein the front piece of the garment comprises a cup of the bra.

15. The method of claim 13, wherein the front piece of the garment comprises a foldable panel of the bra.

16. The method of claim 12, wherein the garment comprises a nursing bra.

17. The method of claim 16, wherein the front piece of the garment comprises a foldable cup of the nursing bra.

18. The method of claim 12, wherein the garment comprises a tank top.

19. The method of claim 18, wherein the front piece of the garment comprises a foldable top panel of the tank top.

20. The method of claim 12, wherein the garment includes a kangaroo pouch for holding an infant.

* * * * *